US005163192A

United States Patent [19]

Watson

[11] Patent Number: 5,163,192

[45] Date of Patent: Nov. 17, 1992

[54] SUN BATHING MAT

[76] Inventor: Carolyn V. Watson, 19507 Aquasco Rd., Aquasco, Md. 20608

[21] Appl. No.: 845,206

[22] Filed: Mar. 3, 1992

[51] Int. Cl.[5] ..... A47G 9/06

[52] U.S. Cl. ..... 5/419; 5/485; 5/490

[58] Field of Search ..... 5/417, 419, 485, 490

[56] References Cited

U.S. PATENT DOCUMENTS

| | | | |
|---|---|---|---|
| D. 261,464 | 10/1981 | Smith . | |
| 2,357,789 | 9/1944 | Levy | 5/490 |
| 2,637,861 | 5/1953 | Kethledge | 5/490 |
| 4,097,944 | 7/1978 | Yulish . | |
| 4,200,942 | 5/1980 | Case . | |
| 4,231,125 | 11/1980 | Tittl . | |
| 4,512,049 | 4/1985 | Henry | 5/417 |

*Primary Examiner*—Michael F. Trettel
*Attorney, Agent, or Firm*—Richard C. Litman

[57] ABSTRACT

A sunbathing mat having a removably attachable inflatable headrest for use on a beach or while visiting a pool. The mat further includes an elongated washable, moisture-absorbent fabric piece. A top portion of the fabric piece is foldable over an intermediate portion of the fabric piece and is releasably attachable in this position to form a flap for enclosing the headrest. A plurality of supple, noncorrosive, nonabrasive straps mate and secure the headrest in the enclosed posture. An alternative mat includes loops and mating stakes. The loops are fixed to the four corners of the sun bathing mat and the mating stakes are insertable into and through each one of the four loops and into a supporting surface to anchor each one of the four corners of the mat to the supporting surface. The mat may also be provided with a plurality of binding cords which enable the user to bind the mat in a small compass. The mat contains no pockets to trap sand or other foreign substances. It does not incorporate abrasive materials and thus, does not promote the risk of snagging the users garment.

9 Claims, 2 Drawing Sheets

SUN BATHING MAT

BACKGROUND OF THE INVENTION

1. Field of the Invention

The present invention relates to a sun bathing mat and more particularly, a soft absorbent sun bathing mat comprising a fabric piece and a releasably attachable inflatable headrest.

2. Description of Prior Art

A visit to a beach or a pool is more often than not associated with the transportation of sundry articles of which frequently include towels, blankets and pillows as well as various lotions and ointments. A towel alone generally provides a clean surface to lie on while offering protection from the discomfort one would encounter when sun bathing directly on a supporting surface such as sand or concrete. Towels typically do not include a headrest. However, there are some towels, more specifically designed for sun bathing, which do have a headrest attached. Some of these towels do not include a removable headrest. Such a towel is less functional for its intended purpose, that is as an article to dry off with. Some of these towels are provided with a removable pillow. Some of these pillows, however, are difficult to remove, again making the towel less convenient to use as an article to dry off with. Other towels may include a removable headrest which incorporates a fastening device having a configuration which has a tendency to trap sand or to be abrasive in nature and thus, may produce discomfort for the user or may snag or damage the users garment. In many instances, using the towel for its intended purpose, that is to dry off, becomes most inconvenient.

U.S. Pat. No. 4,097.944 issued Jul. 4, 1978 to Eugene Norman Yulish discloses a beach mat having integrally attached nonremovable pillow and pockets.

U.S. Pat. No. 4,200,942 issued May 6, 1980 to Marianna Case describes a towel having an inflatable pillow. The pillow may be inserted into and removed from the towel only when the pillow is deflated.

U.S. Pat. No. 4,231,125 issued Nov. 4, 1980 to Joseph F. Tittl discloses a beach towel for use with a pillow. A tube for enclosing a pillow is created by folding a top end of the towel over itself so that a contact surface comprising numerous hook-like projections attaches to a mating contact surface comprising numerous woven loops.

U.S. Pat. No. D 261,464 issued Oct. 27, 1981 to Allan B. Smith illustrates a combination beach towel-carry bag.

None of the above inventions and patents, taken either singly or in combination, is seen to describe the instant invention as claimed.

SUMMARY OF THE INVENTION

The present invention is a sunbathing mat for use on a beach or while visiting a pool. The sunbathing mat provides a clean surface for the user to lie on and protects the user from the discomfort of lying directly on the sand or concrete.

The mat is comprised of an elongated washable, moisture-absorbent fabric piece, preferably rectangular in shape. A top portion of the fabric piece is foldable over itself and is releasably attachable in a position to form a flap for enclosing an inflatable headrest. A plurality of supple, noncorrosive, nonabrasive straps are attached proximate the top portion of the fabric piece in such a manner as to provide pairs of mating tie straps which secure the flap in place and thus, retain the headrest in position. These straps are preferably fabricated from a material such as terri cloth, leather, canvas or a combination thereof.

An alternative mat includes a plurality of loops and mating stakes. At least one loop is fixed to each one of the four corners of the mat. These loops are also preferably fabricated from a supple, noncorrosive, nonabrasive material. The stakes are desirably formed from noncorrosive material and are constructed so as to not embody any sharp or jagged regions. A stake is insertable into and through each one of the four loops and further into a supporting surface, such as sand. This anchors the mat in place reducing the risk of any inadvertent movement.

Another alternative mat provides at least one pair of mating binding cords, also fabricated from a supple, noncorrosive, nonabrasive material. These binding cords enable the user to bind the mat into a small compass. The user simply rolls the mat up to form a small compass having the headrest and the stakes enclosed therein. The mat is bound in this configuration by encircling the compass in opposing directions with each one of the mating binding cords within a pair and tying the mating binding cords together.

A mat of this type is simple to manufacture and easy to use. It contains no pockets and thus, does not trap sand or other foreign substances. The mat does not incorporate abrasive materials, such as hook and loop type fasteners, therefore, is comfortable to use and does not promote the risk of snagging the users garments. Further, this mat requires little effort to use as a towel and is very functional as a towel. The mat does not employ corrosive materials, thus has a long life expectancy. To maintain its aesthetic appearance, the mat is completely washable after each and every use. The mat is easy to store and takes up little space when not in use.

Accordingly, one object of the present invention is to provide a sunbathing mat which is simple to manufacture and easy to use.

Another object of the present invention is to provide a mat which contains no pockets and thus, does not trap sand or other foreign substances.

Another object of the present invention is to provide a mat which does not incorporate abrasive materials, such as hook and loop type fasteners, hence, is comfortable to lie on, convenient to use, functional as a towel, and does not promote the risk of snagging the users garments.

Yet another object of the present invention is to provide a mat which may be anchored to a supporting surface, thereby, reducing the risk of inadvertent movement of the mat.

Still, another object of the present invention is to provide a mat which does not employ corrosive materials, thus has a relatively long life expectancy.

Further, an object of the present invention is to provide a mat which is completely washable after each and every use, is easy to store and requires a nominal amount of storage space.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
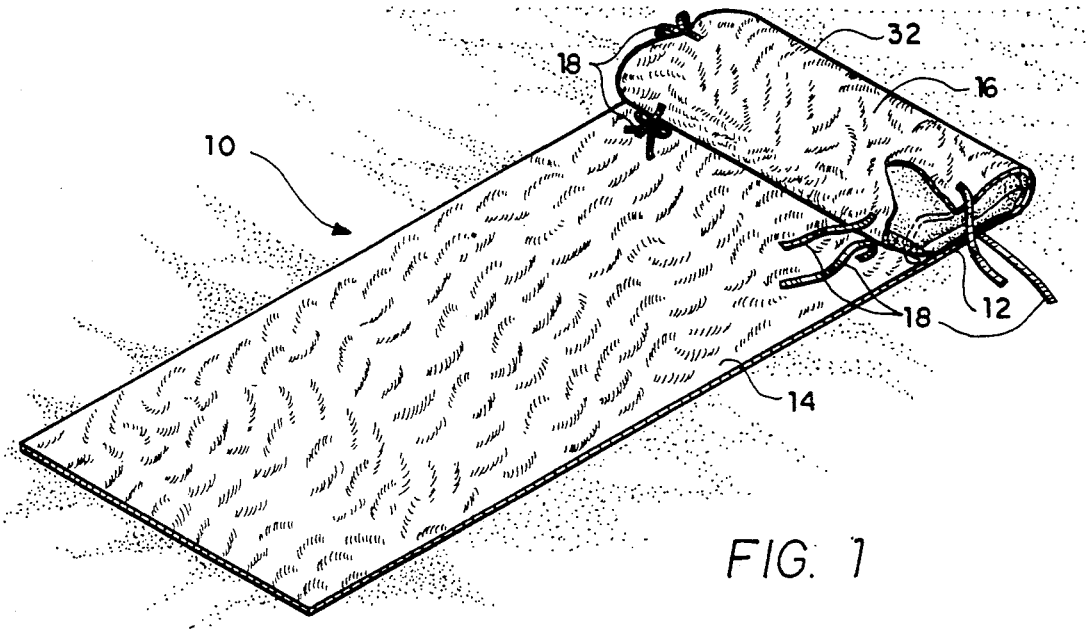
FIG. 1 is an environmental perspective view of a preferred embodiment of the present invention.

Now referring to the drawings, FIG. 1 illustrates the sunbathing mat 10 according to the present invention for use on a beach or at a swimming pool. The sunbathing mat 10 provides a clean surface for the user to lie on and protects the user from the discomfort of lying either on the sand or concrete.

Figure 2:
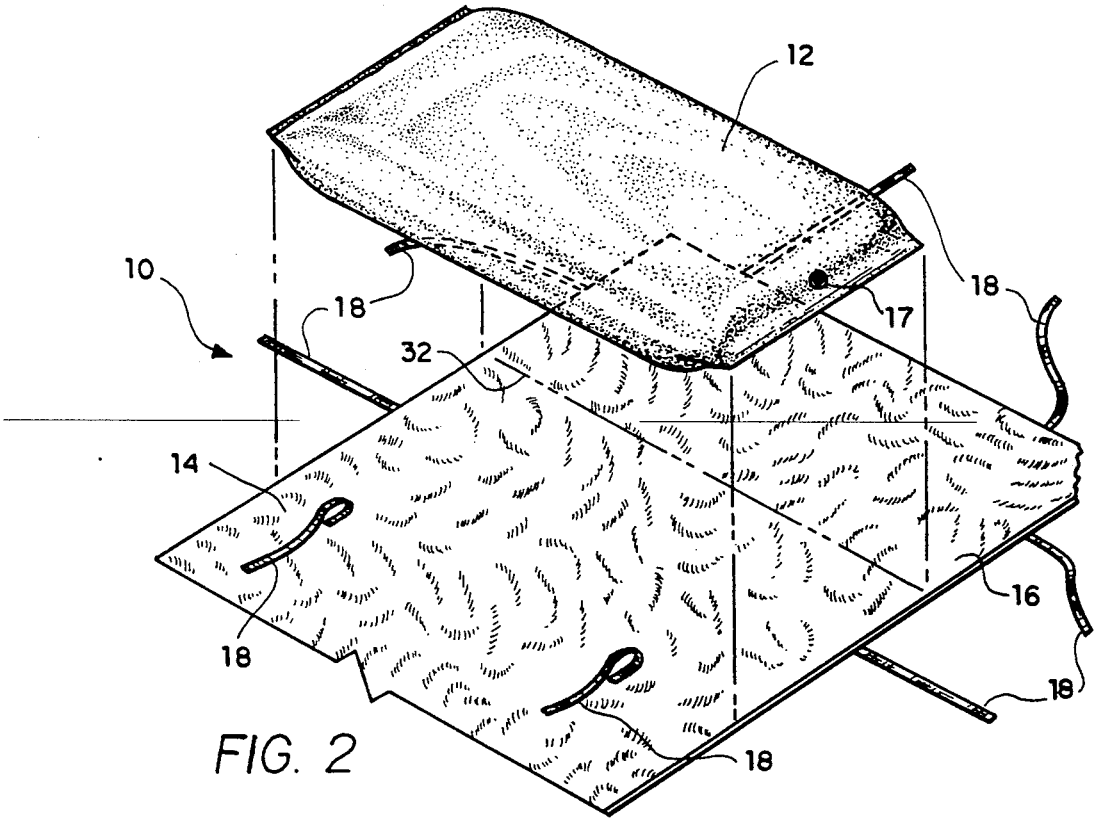
FIG. 2 is an exploded partial perspective view of a preferred embodiment of the present invention.
Figure 3:
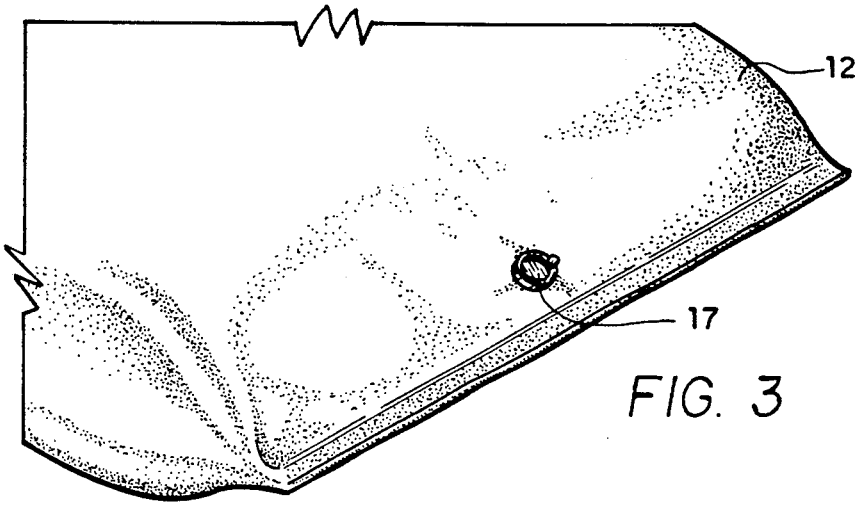
FIG. 3 is a detail view of the valve.

The sun bathing mat 10, as shown in FIGS. 1 and 2, includes a removably attachable, inflatable headrest 12. A retractable valve 17 (as shown in FIGS. 2 and 3) is provided on the headrest 12 which enables the valve 17 to be recessed within the headrest 12 ensuring comfort for the user. The mat 10 is comprised of an elongated, substantially rectangular, washable, moisture-absorbent fabric piece 14. A top portion of the fabric piece 14 is foldable over an intermediate portion of the fabric piece 14 and is releasably attachable in this position via a plurality of straps 18 forming a flap 16 which encloses the inflatable headrest 12. The plurality of straps 18 are produced from supple, noncorrosive, nonabrasive material, such as terri cloth, leather, canvas or a combination thereof, and are attached about the periphery of a top portion and an upper planar surface at a predetermined distance from a laterally extending top edge. A first strap 18 is secured along a laterally extending top edge equidistantly between a longitudinal axis and a left side edge. A second strap 18 is secured along the laterally extending top edge equidistantly between the longitudinal axis and the right side edge. A third strap 18 is secured to an upper planar surface a predetermined distance from the laterally extending top edge and equidistantly between the longitudinal axis and the left side edge. A fourth strap 18 is secured to the upper planar surface a predetermined distance from the laterally extending top edge and equidistantly between the longitudinal axis and the right side. The straps 18 are arranged in such a manner that the first and second straps 18 mate with the third and fourth straps 18, respectively, when the top portion of the fabric piece 14 is folded over the intermediate portion of the fabric piece 14 to form the flap 16. The mating straps 18 are tied together to form a first and second means to secure the flap 16, thus enclosing and retaining the headrest 12 along a bottom edge of the headrest 12. The mat 10 further includes a fifth strap 18 which is secured along the longitudinally extending left side edge and which is spaced equidistantly between the laterally extending top edge and the fold 32. A sixth strap 18 is secured along the longitudinally extending right side edge and is spaced equidistantly between the laterally extending top edge and the fold 32. A seventh strap 18 is secured along the longitudinally extending left side edge a predetermined distance from the fold 32 and is located between the fold 32 and a laterally extending bottom edge. An eighth strap 18 is secured along the longitudinally extending right side edge a predetermined distance from the fold 32 and is located between the fold 32 and the laterally extending bottom edge. The fifth and sixth straps 18 mate with the seventh and eighth straps 18, respectively, when the top portion of the fabric piece 14 is folded over the intermediate portion of the fabric piece 14 forming the flap 16. The mating straps 18 are tied together to form a third and a fourth means to secure the flap 16, thus further enclosing and retaining the headrest 12 along the left side edge and the right side edge thereof.

Figure 4:
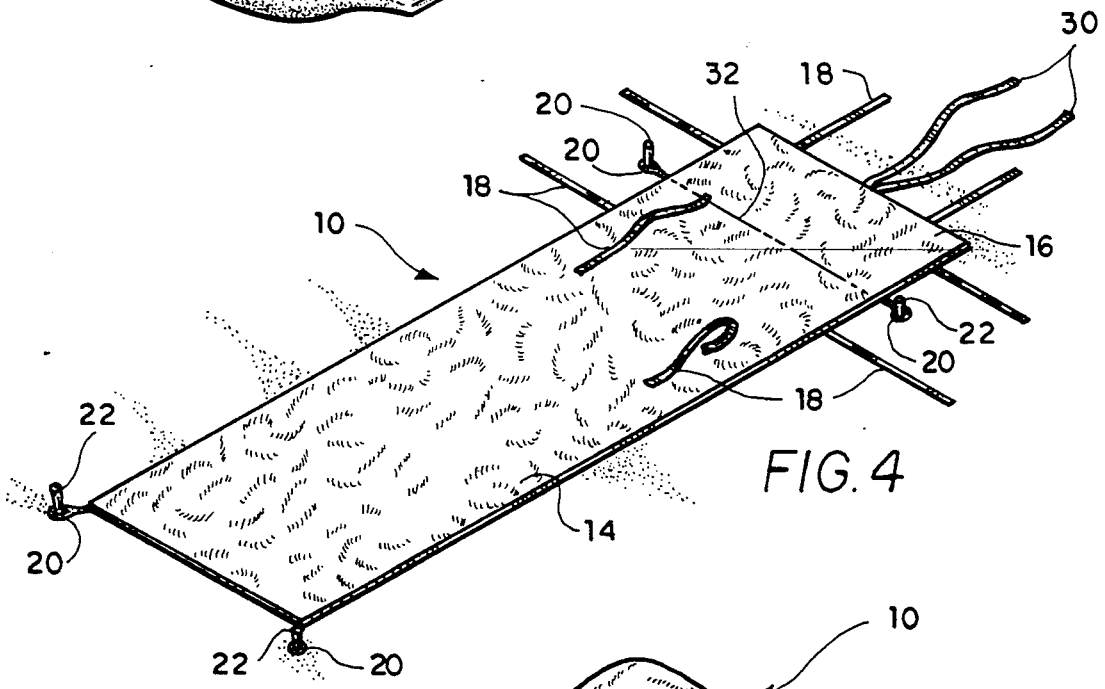
FIG. 4 is a perspective view of an alternative embodiment of the present invention.

FIG. 4 shows an alternative mat 10 which includes a plurality of loops 20 and mating stakes 22. One loop 20 is fixed to each one of the bottom corners of the mat 10 and one loop being fixed along each of the longitudinally extending sides of the mat 10 where the fold 32 intersects with each longitudinally extending side (see also FIG. 1). Likewise, these loops 20 are preferably fabricated from a supple, noncorrosive material, such as terri cloth, leather, canvas or a combination thereof. These stakes 22 are desirably formed from a noncorrosive material and constructed so as to not embody any sharp or jagged regions. These stakes 22 are each insertable into and through a respective loop 20 and further into a supporting surface, such as sand, providing a means to anchor the mat 10 to the supporting surface, thus reducing the risk of inadvertent movement of the mat 10.

Figure 5:
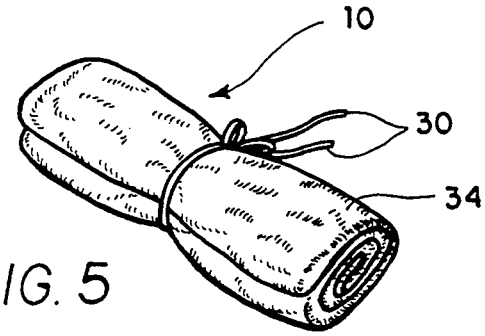
FIG. 5 is a perspective view of the present invention rolled and secured into a small compass.

FIGS. 4 and 5 show the mat 10 providing a plurality of binding cords 30, also preferably produced from a supple, noncorrosive, nonabrasive material such as terri cloth, leather, canvas or a combination thereof These binding cords 30 are attached to the laterally extending top edge of the fabric piece 14. Any number of binding cords 30 may be employed and attached to points which permit the mat 10 to be rolled up and bound in the form of a small compass 34. This allows the mat 10 to be easily and conveniently transported and to be stored in a small storage area. The user simply rolls the mat 10 up into a small compass 34 with the headrest 12 and the stakes 22 enclosed therein. The mat 10 is bound by opposingly encircling the compass 34 with the mating binding cords 30 and tying the pair of binding cords 30 together.

The mat 10 is simple to manufacture and easy to use. The mat 10 contains no pockets and thus, does not trap sand or other foreign substances. The mat 10 does not incorporate abrasive materials, such as hook and loop type fasteners, thus does not promote the risk of snagging the users garment while providing a mat 10 which is comfortable to use and functional when used to dry oneself. The mat 10 does not employ corrosive materials, thus it has a long life expectancy. The mat 10 is also washable so the aesthetic appearance thereof may be maintained.

It is to be understood that the present invention is not limited to the embodiments described above, but encompasses any and all embodiments within the scope of the following claims.

I claim:

1. A sunbathing mat comprising:

a. an elongated moisture-absorbent fabric piece having an upper planar surface and a longitudinal axis, which is defined by opposing, laterally extending top and bottom edges and opposing, longitudinally extending left and right side edges;

b) a top portion of said fabric piece being foldable over an intermediate portion and being releasably attachable forming a flap which covers and encloses a headrest; and c) a plurality of supple, noncorrosive, nonabrasive straps, a first one of said straps being secured along said laterally extending top edge equidistantly between said longitudinal axis and said left side edge, a second one of said straps being secured along said laterally extending top edge equidistantly between said longitudinal axis and said right side edge, a third one of said straps being secured to said upper planar surface a predetermined distance from said laterally extending top edge and equidistantly between said longitudinal axis and said left side edge, and a fourth one of said straps being secured to said upper planar surface a predetermined distance from said laterally extending top edge and equidistantly between said longitudinal axis and said right side edge, and whereby said first and second straps mate with said third and fourth straps, respectively, when said top portion of said fabric piece is folded over said intermediate portion of said fabric piece to form said flap, and said mating straps are tied together to form a first and second means to secure said flap, thus enclosing and retaining said headrest along a bottom edge of said headrest.

2. The sun bathing mat according to claim 1, wherein said headrest is inflatable.

3. The sun bathing mat according to claim 1, further includes a plurality of supple, noncorrosive, nonabrasive loops and a plurality of mating noncorrosive stakes, a first one of said loops being attached to a left bottom corner, a second one of said loops being attached to a right bottom corner, a third one of said loops being attached to an intersection of said fold and said longitudinally extending left side edge, and a fourth one of said loops being attached to an intersection of said fold and said longitudinally extending right side edge, whereby when said fabric piece is lying in a horizontal plane on a substantially soft surface, one of each of said stakes is insertable into and through one of each of said loops, respectively, to penetrate the substantially soft surface and anchor said fabric thereon.

4. The sun bathing mat according to claim 3, further comprising a mating pair of supple, noncorrosive, nonabrasive binding cords attached thereon to enable said fabric piece to be bound into a small compass, whereby said stakes and said headrest are rolled up within said fabric piece forming said compass, said pair of mating binding cords opposingly encircle said compass such that said pair of binding cords are tied together to retain said fabric piece in the form of said compass and to retain said headrest and said stakes therein.

5. A sunbathing mat having a removably attached, inflatable headrest, said sun bathing mat comprising:

a) an elongated moisture-absorbent fabric piece, which, when lying in a horizontal plane, defines the extent of said mat which is further defined by an upper planar surface and opposing, laterally extending top and bottom edges and opposing, longitudinally extending left and right side edges;

b) a top portion of said fabric piece being foldable over an intermediate portion of said fabric piece and being releasably attachable to said intermediate portion to form a flap which encloses and retains said headrest, said headrest being centered substantially on a longitudinal axis of said fabric piece and having a width extending a predetermined distance short of said left and right side edges;

c) a plurality of supple, noncorrosive, nonabrasive straps, a first one of said straps being secured along said laterally extending top edge equidistantly between said longitudinal axis and said left side edge, a second one of said straps being secured along said laterally extending top edge equidistantly between said longitudinal axis and said right side edge, a third one of said straps being secured to said upper planar surface a predetermined distance from said laterally extending top edge and equidistantly between said longitudinal axis and said left side edge, and a fourth one of said straps being secured to said upper planar surface a predetermined distance from said laterally extending top edge and equidistantly between said longitudinal axis and said right side edge, and whereby said first and second straps mate with said third and fourth straps, respectively, when said top portion of said fabric piece is folded over said intermediate portion of said fabric piece to form said flap, and said mating straps are tied together to form a first and second means to secure said flap, thus enclosing and retaining said headrest along a bottom edge of said headrest; and d) a plurality of supple, noncorrosive, nonabrasive loops and a plurality of mating noncorrosive stakes, a first one of said loops being attached to a left bottom corner, a second one of said loops being attached to a right bottom corner, and a third one of said loops being attached to an intersection of said fold and said longitudinally extending left side edge, and a fourth one of said loops being attached to an intersection of said fold and each of said longitudinally extending right side edge, whereby when said fabric piece is lying in a horizontal plane on a substantially soft surface, one of each of said stakes is insertable into and through one of each of said loops, respectively, to penetrate the substantially soft surface and to anchor said fabric thereon.

6. The sun bathing mat according to claim 5, further comprising a mating pair of supple, noncorrosive, nonabrasive binding cords attached to said fabric piece to enable said fabric piece to be bound into a small compass, whereby said stakes and said headrest are rolled up within said fabric piece forming said compass, said pair of mating binding cords opposingly encircle said compass such that said mating pair of binding cords are tied together to retain said fabric piece in the form of said compass and to retain said headrest and said stakes therein.

7. A sunbathing mat having a removably attached, inflatable headrest, said sun bathing mat comprising:

a) an elongated, substantially rectangular, washable, moisture-absorbent fabric piece, which, when lying in a horizontal plane, defines the extent of the mat, which is further defined by opposing, laterally extending top and bottom edges, opposing, longitudinally extending left and right side edges, and opposing, upper and lower planar surfaces;

b) a top portion of said fabric piece being foldable over an intermediate portion of said fabric piece and being releasably attached to said intermediate portion of said fabric piece to form a flap for enclosing and retaining said headrest therein, said headrest being centered substantially on a longitudinal axis of said fabric piece and having a width extending a predetermined distance short of said left and right side edges;

c) a plurality of supple, noncorrosive, nonabrasive straps, a first one of said straps being secured along said laterally extending top edge equidistantly between said longitudinal axis and said left side edge, a second one of said straps being secured along said laterally extending top edge a equidistantly between said longitudinal axis and said right side edge, a third one of said straps being secured to said upper planar surface a predetermined distance from said laterally extending top edge and equidistantly between said longitudinal axis and said left side edge, and a fourth one of said straps being secured to said upper planar surface a predetermined distance from said laterally extending top edge and equidistantly between said longitudinal axis and said right side edge, and whereby said first and second straps mate with said third and fourth straps, respectively, when said top portion of said fabric piece is folded over said intermediate portion of said fabric piece to form said flap, and said mating straps are tied together to form a first and second means to secure said flap, thus enclosing and retaining said headrest along a bottom edge of said headrest; and d) said plurality of supple, noncorrosive, nonabrasive straps further including a fifth one of said straps being secured along said longitudinally extending left side edge and equidistantly between said laterally extending top edge and said fold, a sixth one of said straps being secured along said longitudinally extending right side edge and equidistantly between said laterally extending top edge and said fold, a seventh one of said straps being secured along said longitudinally extending left side edge a predetermined distance from said fold and being located between said fold and laterally extending bottom edge, and an eighth one of said straps being secured along said longitudinally extending right side edge a predetermined distance from said fold and being located between said fold and laterally extending bottom edge, and whereby said fifth and said sixth straps mate with said seventh and said eighth straps, respectively, when said top portion of said fabric piece is folded over said intermediate portion of said fabric piece to form said flap, and said mating straps are tied together to form a third and a fourth means to secure said flap, thus enclosing and retaining said headrest along a left side edge and a right side edge of said headrest.

8. The sun bathing mat according to claim 7, further includes a plurality of supple, noncorrosive, nonabrasive loops and a plurality of mating noncorrosive stakes, a first one of said loops being attached to a left bottom corner, a second one of said loops being attached to a right bottom corner, a third one of said loops being attached to an intersection of said fold and said longitudinally extending left side edge, and a fourth one of said loops being attached to an intersection of said fold and said longitudinally extending right side edge, whereby when said fabric piece is lying in a horizontal plane on a substantially soft surface, one of each of said stakes is insertable into and through one of each of said loops, respectively, to penetrate the substantially soft surface and anchor said fabric thereon.

9. The sun bathing mat according to claim 7, further comprising a mating pair of supple, noncorrosive, nonabrasive binding cords attached thereon to enable said fabric piece to be bound into a small compass, whereby said stakes and said headrest are rolled up within said fabric piece forming said compass, said pair of mating binding cords opposingly encircle said compass such that said pair of binding cords are tied together to retain said fabric piece in the form of said compass and to retain said headrest and said stakes therein.

* * * * *